US009915241B2

(12) United States Patent
Kim et al.

(10) Patent No.: US 9,915,241 B2
(45) Date of Patent: Mar. 13, 2018

(54) ROTARY VANE ACTUATOR WITH FLUID ACTUATED MECHANICAL LOCK

(71) Applicant: Woodward, Inc., Fort Collins, CO (US)

(72) Inventors: Joseph H. Kim, Valencia, CA (US); Robert P. O'Hara, Castaic, CA (US); Shahbaz H. Hydari, Los Angeles, CA (US)

(73) Assignee: Woodward, Inc., Fort Collins, CO (US)

( * ) Notice: Subject to any disclaimer, the term of this patent is extended or adjusted under 35 U.S.C. 154(b) by 622 days.

(21) Appl. No.: 13/830,814

(22) Filed: Mar. 14, 2013

(65) Prior Publication Data

US 2014/0271295 A1 Sep. 18, 2014

(51) Int. Cl.
*F04D 29/08* (2006.01)
*F03C 2/22* (2006.01)
*F04C 15/00* (2006.01)

(52) U.S. Cl.
CPC ..... *F03C 2/22* (2013.01); *F04C 15/0007* (2013.01)

(58) Field of Classification Search
CPC ..... F01C 9/002; F01C 20/006; F15B 15/262; F15B 2015/268
USPC ..... 91/44, 45
See application file for complete search history.

(56) References Cited

U.S. PATENT DOCUMENTS 1,769,372 A * 7/1930 Koehn ..... B24B 15/08 91/339
2,564,206 A * 8/1951 Johnson ..... F15B 7/00 91/44
2,966,144 A 12/1960 Self
3,017,807 A * 1/1962 Grover ..... F15B 15/12 188/134
3,179,018 A * 4/1965 Rumsey ..... E02F 3/384 188/72.4
4,510,850 A * 4/1985 MacK ..... F15B 15/12 277/644
4,823,678 A * 4/1989 Sollami ..... F15B 15/12 92/121
5,054,374 A 10/1991 Scobie et al.
(Continued)

FOREIGN PATENT DOCUMENTS

DE 875146 C * 4/1953 ..... F01C 9/002
GB 2030652 A * 4/1980 ..... F01C 9/002
(Continued)

*Primary Examiner* — Michael Leslie
*Assistant Examiner* — Matthew Wiblin
(74) *Attorney, Agent, or Firm* — Fish & Richardson P.C.

(57) ABSTRACT

The subject matter of this specification can be embodied in, among other things, a seal assembly that includes a compressible seal slidably mounted on a central longitudinal shaft of a rotor assembly, the seal having a first lateral surface adapted for contacting a first end surface of a first stator and a first end surface of the second stator and a first end surface of a first longitudinal vane and a first end surface of a second longitudinal vane, a compression member slidably mounted on the shaft, and a locking piston slidably mounted on the shaft, the locking piston including an opening sized to receive the shaft, an end surface adapted to contact the compression member, a circumferential surface sized to be received in the bore of the housing, and a lateral surface adapted to receive actuation fluid.

16 Claims, 6 Drawing Sheets

(56) References Cited

U.S. PATENT DOCUMENTS

| | | | | |
|---|---|---|---|---|
| 5,722,616 | A | 3/1998 | Durand | |
| 7,930,971 | B2 * | 4/2011 | Werkhoven | F15B 15/262 92/121 |

FOREIGN PATENT DOCUMENTS

| | | | | |
|---|---|---|---|---|
| GB | 2129514 | A * | 5/1984 | B25J 9/146 |
| WO | WO 0246580 | A1 * | 6/2002 | F01C 1/073 |
| WO | WO 2007068224 | A1 * | 6/2007 | F01C 9/002 |

* cited by examiner

ROTARY VANE ACTUATOR WITH FLUID ACTUATED MECHANICAL LOCK

TECHNICAL FIELD

This invention relates to an actuator device and more particularly to a rotary vane type actuator device wherein the vanes of the rotor are moved by fluid under pressure.

BACKGROUND

Rotary hydraulic actuators of various forms are currently used in industrial mechanical power conversion applications. This industrial usage is commonly for applications where continuous inertial loading is desired without the need for load holding for long durations, e.g. hours, without the use of an external fluid power supply. Aircraft flight control applications generally implement loaded positional holding, for example, in a failure mitigation mode, using substantially only the blocked fluid column to hold position.

In certain applications, such as primary flight controls used for aircraft operation, positional accuracy in load holding by rotary actuators is desired. Positional accuracy can be improved by minimizing internal leakage characteristics inherent to the design of rotary actuators. However, it can be difficult to provide leak-free performance in typical rotary hydraulic actuators, e.g., rotary "vane" or rotary "piston" type configurations.

SUMMARY

In general, this document relates to rotary vane actuators.

In a first aspect, a seal assembly for a rotary vane actuator includes a compressible seal slidably mounted on a central longitudinal shaft of a rotor assembly, the seal having an outer circumferential surface sized to be received in a bore of a stator housing and a central opening sized to receive the central longitudinal shaft, a first lateral surface adapted for contacting a first end surface of a first stator and a first end surface of the second stator and a first end surface of a first longitudinal vane and a first end surface of a second longitudinal vane, a compression member slidably mounted on the central longitudinal shaft, and a locking piston slidably mounted on the central longitudinal shaft, the locking piston including an opening sized to receive the central longitudinal shaft, an end surface adapted to contact the compression member, a circumferential surface sized to be received in the bore of the housing, and a lateral surface adapted to receive actuation fluid.

In a second aspect, a sealing mechanism for a rotary vane actuator includes a stator housing having a bore disposed axially therethrough and a rotor assembly including a central longitudinal shaft having a central axis and at least a first longitudinal vane disposed radially on the central longitudinal shaft, and a second longitudinal vane disposed radially on the central longitudinal shaft. The sealing mechanism also includes a stator assembly including a first stator element disposed in the bore of the stator housing and a second stator element disposed in the stator housing, wherein the first longitudinal vane and the first stator define a first pressure chamber inside the bore of the stator housing, the second longitudinal vane and the first stator define a second pressure chamber inside the bore of the stator housing, the second longitudinal vane and the second stator define a third pressure chamber inside the bore of the stator housing, and the second longitudinal vane and the first stator define a fourth pressure chamber inside the bore of the stator housing. The sealing mechanism also includes a seal assembly including a compressible seal slidably mounted on the central longitudinal shaft of the rotor assembly, the seal having an outer circumferential surface received in the bore of the stator housing, a compression member slidably mounted on the central longitudinal shaft, the member, and a locking piston slidably mounted on the central longitudinal shaft, the locking piston including an opening sized to receive the central longitudinal shaft, an end surface adapted to contact the compression member, a circumferential surface sized to be received in the bore of the housing, and a lateral surface adapted to receive actuation fluid.

Various embodiments can include some, all, or none of the following features. The sealing mechanism can include a port and passageways in the housing adapted to provide actuation fluid to the second lateral surface of the locking piston. The sealing mechanism can have a biasing member disposed around the central longitudinal shaft in the central bore of the housing having a first end contacting the compression plate and a second end adapted to contact the locking piston. The sealing mechanism can also include a first seal groove disposed in the first end surface of the first longitudinal vane and in the first end surface of the second longitudinal vane and a seal disposed in said first seal groove, and a second seal groove disposed in the first end surface of the first stator element and the first end surface of the second stator element, and a seal disposed in said second seal groove and wherein a portion of the first surface of the compression seal of the seal assembly contacts the seal disposed in the seal groove of each of the first and second longitudinal vanes and the first and second stators.

In a third aspect, a sealing mechanism for a rotary vane actuator includes a stator housing having a bore disposed axially therethrough, and a rotor assembly including a central longitudinal shaft having a central axis, and at least a first longitudinal vane disposed radially on and rigidly connected to the central longitudinal shaft, said first longitudinal vane having a first end surface disposed perpendicular to the central axis and a second end surface disposed perpendicular to the central axis, and a second longitudinal vane disposed radially on and rigidly connected to the central longitudinal shaft, said first longitudinal vane having a first end surface disposed perpendicular to the central axis, and a second end surface disposed perpendicular to the central axis, said second vane disposed substantially opposite from the first vane. The sealing mechanism also includes a stator assembly including a first stator element having a concave interior surface adapted to contact a cylindrical surface on the central longitudinal shaft and a convex outer surface adapted to be secured to the bore of the stator housing, a first end surface disposed perpendicular to the central axis, and a second end surface disposed perpendicular to the central axis, and a second stator element having a concave interior surface adapted to contact a second cylindrical surface on the central longitudinal and a convex outer surface adapted to be secured to the bore of the stator housing, a first end surface disposed perpendicular to the central axis, and a second end surface disposed perpendicular to the central axis. The sealing assembly also includes a seal assembly including a compressible seal slidably mounted on the central longitudinal shaft of the rotor assembly, the seal having an outer circumferential surface sized to be received in the bore of the stator housing and a central opening sized to receive the central longitudinal shaft, a first lateral surface adapted for contacting the first end surface of the first stator and the first end surface of the second stator and the first end surface of the first longitudinal vane and the first end surface of the second longitudinal vane, a compression member slidably mounted on the central longitudinal shaft, the plate having a first surface adapted to contact a second lateral surface of the compression seal, a locking piston slidably mounted on the central longitudinal shaft, the locking piston including an opening sized to receive the central longitudinal shaft, an end surface adapted to contact the compression plate, a circumferential surface sized to be received in the bore of the housing, and a lateral surface adapted to receive actuation fluid.

Various embodiments can include some, all, or none of the following features. The sealing mechanism can also include a port and passageways in the housing adapted to provide actuation fluid to the second lateral surface of the locking piston. The sealing mechanism can have a biasing member disposed around the central longitudinal shaft in the central bore of the housing having a first end contacting the compression plate and a second end adapted to contact the locking piston. The sealing mechanism can also include a first seal groove disposed in the first end surface of the first longitudinal vane and in the first end surface of the second longitudinal vane and a seal disposed in said first seal groove, and a second seal groove disposed in the first end surface of the first stator element and the first end surface of the second stator element, and a seal disposed in said second seal groove and wherein a portion of the first surface of the compression seal of the seal assembly contacts the seal disposed in the seal groove of each of the first and second longitudinal vanes and the first and second stators. The first longitudinal vane and the first stator can define a first pressure chamber inside the bore of the stator housing, the second longitudinal vane and the first stator can define a second pressure chamber inside the bore of the stator housing, the second longitudinal vane and the second stator can define a third pressure chamber inside the bore of the stator housing, and the second longitudinal vane and the first stator can define a fourth pressure chamber inside the bore of the stator housing.

In a fourth aspect, a method of actuation of a seal assembly includes providing a rotary vane actuator including a stator housing having a bore disposed axially therethrough and a rotor assembly including a central longitudinal shaft having a central axis, and at least a first longitudinal vane disposed radially on the central longitudinal shaft. The actuator also includes at least a second longitudinal vane disposed radially on the central longitudinal shaft and a stator assembly including a first stator element disposed in the bore of the stator housing, and a second stator element disposed in the stator housing, wherein the first longitudinal vane and the first stator define a first pressure chamber inside the bore of the stator housing, the second longitudinal vane and the first stator define a second pressure chamber inside the bore of the stator housing, the second longitudinal vane and the second stator define a third pressure chamber inside the bore of the stator housing, and the second longitudinal vane and the first stator define a fourth pressure chamber inside the bore of the stator housing. The actuator includes a seal assembly having a compressible seal slidably mounted on the central longitudinal shaft of the rotor assembly, the seal having an outer circumferential surface received in the bore of the stator housing, a lateral surface and an end surface, a compression member slidably mounted on the central longitudinal shaft, the member having a first surface and second surface, a locking piston slidably mounted on the central longitudinal shaft, the locking piston including an end surface, a circumferential surface received in the bore of the housing, a lateral surface and a biasing member disposed between the compression member and the locking piston. The method also includes providing pressurized fluid to the end surface of the locking piston, slidably displacing the locking piston and contacting the first surface of the compression plate, slidably displacing the compression plate and thereby partially compressing the biasing member, and contacting the first surface of the compressible seal with the biasing member and slidably displacing the compressible seal into sealing contact with a first end surface of the first longitudinal vane and a first end surface of the second longitudinal vane and a first end surface of the first stator element and a first end surface of the second stator element.

Various embodiments can include some, all, or none of the following features. The rotary actuator can also include a first seal groove disposed in the first end surface of the first longitudinal vane and in the first end surface of the second longitudinal vane and a seal disposed in said first seal groove, and a second seal groove disposed in the first end surface of the first stator element and the first end surface of the second stator element, and a seal disposed in said second seal groove, and the method further includes contacting with a portion of the first surface of the compression seal of the seal assembly with the seal disposed in the seal groove of each of the first and second longitudinal vanes and the first and second stators.

The systems and techniques described here may provide one or more of the following advantages. First, a system can provide improved position-holding capability. Second, the system can provide a fail-safe mechanism that can provide position-holding capability in event of loss of actuation fluid pressure.

The details of one or more implementations are set forth in the accompanying drawings and the description below. Other features and advantages will be apparent from the description and drawings, and from the claims.

DETAILED DESCRIPTION

Figure 1:
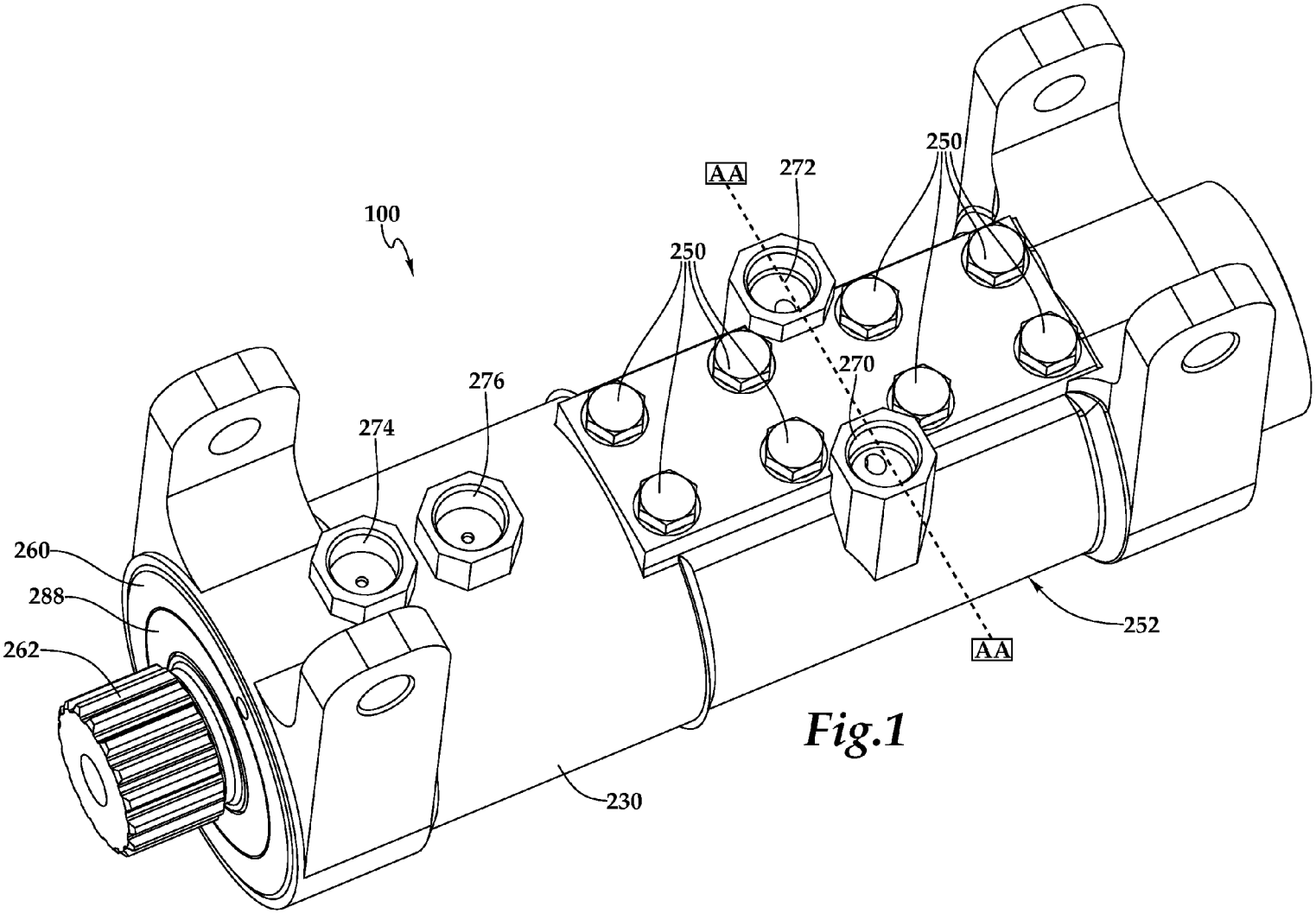
FIG. 1 is a perspective view of an example rotary vane actuator with a fluid actuated mechanical lock.

FIG. 1 is a perspective view of an example rotary vane actuator with a fluid actuated mechanical lock 100. In general, the actuator 100 integrates one or more rotors and rotor vanes with compressible seals at the ends of the rotor shaft. A fluid actuated locking mechanism provides a dual-mode operation to impart different sealing conditions during "normal" and "failure" operation cases. During "normal" mode operation, the actuator 100 sealing functions like a typical rotary vane actuator (RVA) allowing some fluid leakage through rotor vane seal to stator seal interfaces. During "failure" mode operation, a fluid pressure activated spring load mechanically squeezes the rotor/stator vane seal interface to counteract the force of fluid pressure trapped in the actuator 100, thereby substantially locking the fluid within the pressure chamber. Internal fluid leakage across the sealing interfaces can be significantly reduced as fluid column pressure is contained.

The use of such fluid actuated locking mechanisms increases the ability of the actuator 100 to maintain a selected rotational position in the event of a malfunction, e.g., hydraulic failure. In general, by providing this mechanical lock, the position holding ability of an RVA such as the example rotary vane actuator with a fluid actuated mechanical lock 100 is enhanced.

Figure 2:
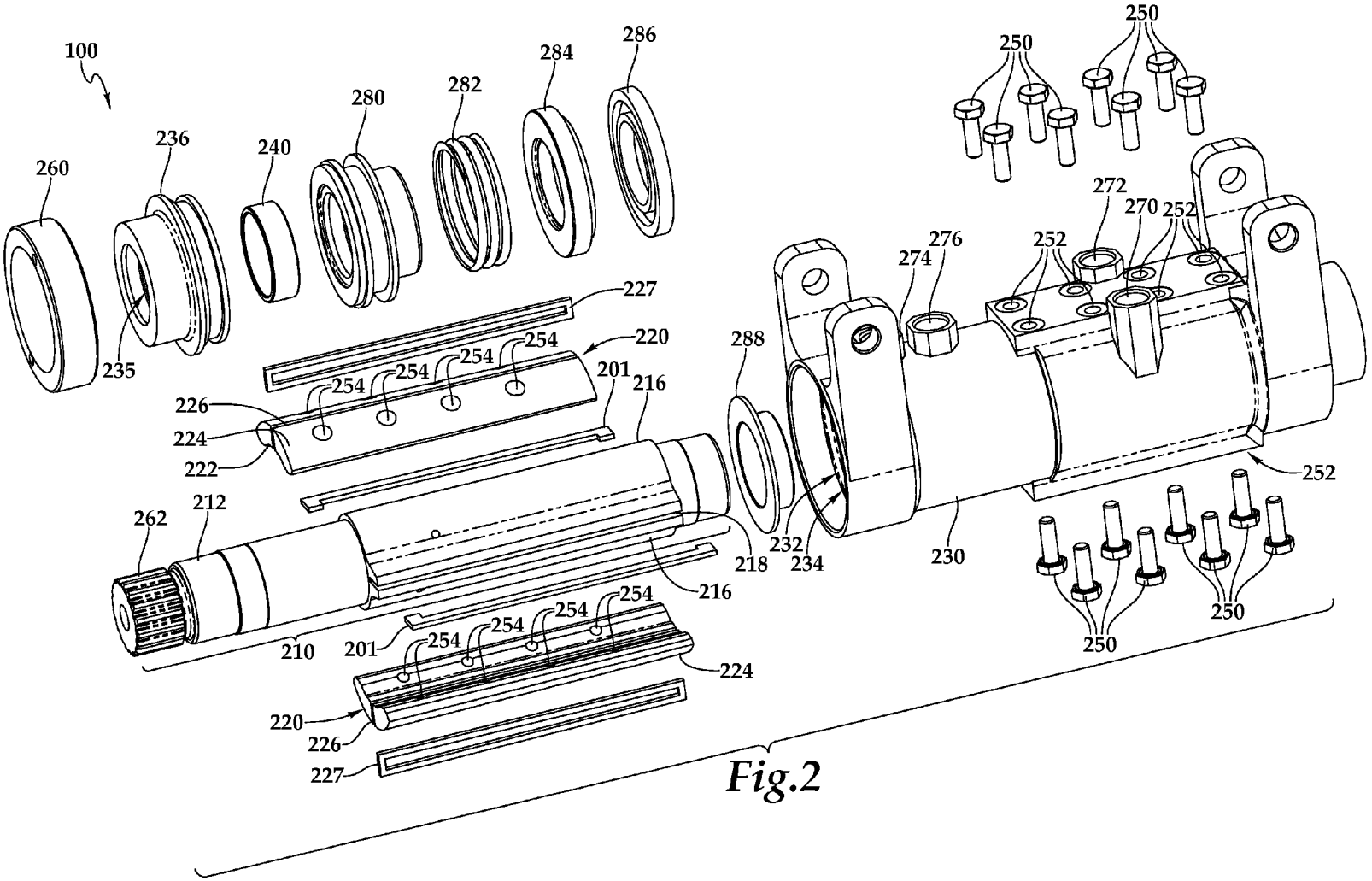
FIG. 2 is an exploded view of an example rotary vane actuator with a fluid actuated mechanical lock.

FIG. 2 is an exploded view of the example rotary vane actuator with a fluid actuated mechanical lock 100

A rotor 210 includes a central shaft 212. Two integral rotor vanes 216 are formed axially along the central shaft 212. The rotor vanes 216 include a seal groove 218. The seal groove 218 is formed axially along an outward peripheral edge of each of the rotor vanes 216. The seal groove 218 is formed to accommodate a rotor seal 201 and bring the rotor seal 201 into sealing contact with an inner surface 232 of a central bore 234 of a housing 230.

The example rotary vane actuator with a fluid actuated mechanical lock 100 includes a pair of stator sections 220. Each of the stator sections 220 is a generally semicircular plate having an axial length substantially equal to the lengths of the rotor vanes 216, a thickness substantially equal to the difference between the radius of the central shaft 212 and the radius of the central bore 234 (less tolerance for movement between the elements), a radially inner surface 222 formed with a curvature substantially equal to that of the central shaft 212, and a radially outward surface 224 formed with a curvature substantially equal to that of the inner surface 232 of the central bore 234.

A seal groove 226 is formed axially along a central portion of the surfaces 222 and 224, and about the ends of each stator section 220. A pair of stator seals 227 is formed to be accommodated within the seal grooves 226. In some implementations the stator seal is a single continuous seal inserted into the seal grooves 226 and is positioned on both surfaces 222 and 224 and around the longitudinal ends of the stator 226. The seal grooves 226 are formed to bring the stator seals 227 into sealing contact with the rotor shaft 212, an upper corner seal 286, a lower corner seal 288, and the inner surface 232 of the central bore 234 when the actuator 100 is assembled. As used herein, when referring to a "seal disposed in a seal groove," it is understood that at least a portion of the seal is positioned in the seal groove but a portion of the seal may extend outside the groove to make sealing contact with other elements of the actuator. In some implementations, each of the stator sections 220 can include two or more of the seal grooves 226 and the stator seals 227 arranged along the length of the stator section 220.

The rotor shaft 212 is supported by a bearing 240. When assembled, the bearing 240 provides support between the rotor shaft 212 and a central bore 235 of the bearing housing 236 and end cap 260.

A compression plate 284, a spring 282, and a lock piston 280 are placed about the rotor shaft 212. The spring 282 provides a compliant force separating the compression plate 284 and the lock piston 280. The compression plate 284, the spring 282, and the lock piston 280 will be discussed further in the descriptions of FIGS. 3A and 6A.

During assembly the two stator sections 220 are inserted into the bore 234 of the housing 230. A collection of fasteners 250, e.g., bolts, are passed through a collection of holes 252 formed through the bore 234 of the housing 230. The fasteners 250 are threaded into corresponding threaded holes 254 formed in the stator sections 220 to removably secure the stator sections 220 to the housing 230. An end cap 260 is placed about a bearing housing 236 to at least partially retain the rotor 210, the bearing 240, the upper corner seal 286, the lower corner seal 288, the compression plate 284, the spring 282, the lock piston 280, and the bearing housing 236 axially within the central bore 234. A spline section 262 extends radially outward from an end portion of the rotor shaft 212. When assembled the spline section 262 will extend from the central bore 235 of the bearing housing 236 and a central bore 262 of the end cap 260 and thereby be positioned outside of the housing 230. The spline section 262 can be attached to an item to be moved (actuated) by the actuator 100.

A pair of fluid ports 270, 272 are in fluidic communication with fluid chambers defined by an assemblage of the housing 230, the rotor 210, the stator seals 227, and the rotor seal 201. A pair of fluid ports 274, 276 is in fluidic communication with a lock valve assembly (not shown). The fluid ports 270, 272 will be discussed further in the descriptions of FIGS. 4 and 5A-5D. The fluid ports 274, 276 and the lock valve assembly will be discussed further in the descriptions of FIGS. 3A, 3B, 4A, and 4B.

Figures 3A, 3B, 4:
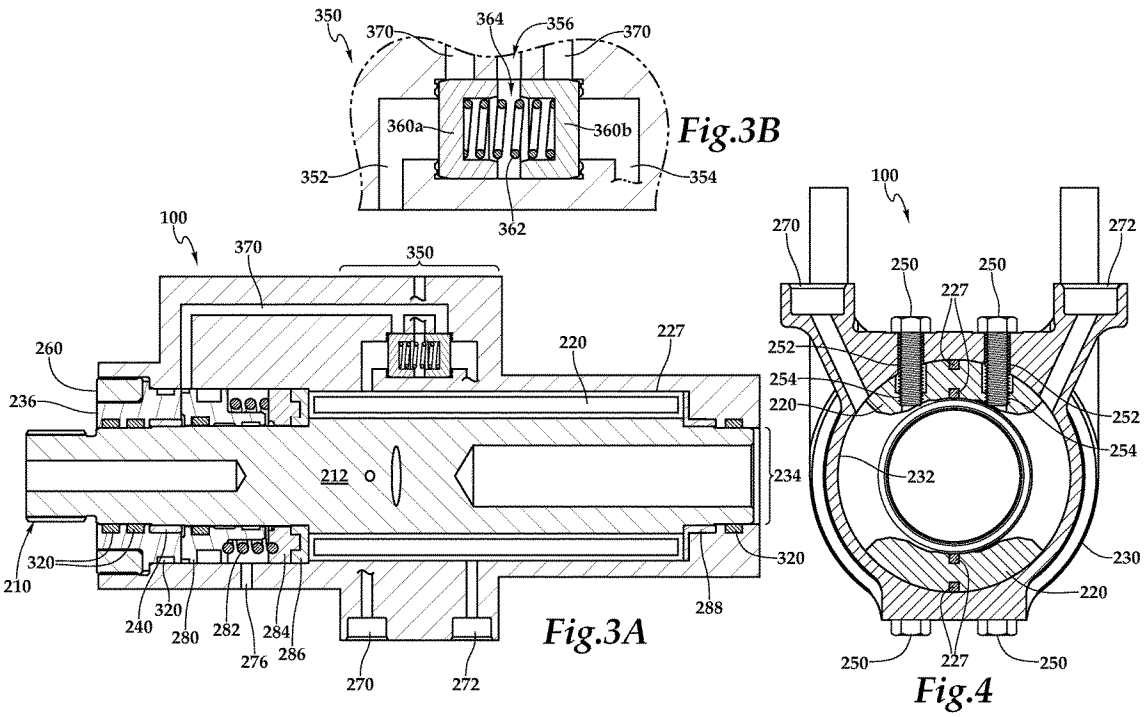
FIGS. 3A and 3B are cross-sectional side views of an example rotary vane actuator with a fluid actuated mechanical lock.
FIG. 4 is a cross-sectional end view of an example rotary vane actuator with a fluid actuated mechanical lock.

FIG. 3A is a cross-sectional side view of the example rotary vane actuator with a fluid actuated mechanical lock 100 in an assembled form. As discussed in the description of FIG. 2, the actuator 100 includes the rotor 210, which is positioned within the central bore 234 of the housing 230. The rotor 210 is rotatably supported at a distal end by the lower corner seal 288 and the housing 230. The rotor 210 is rotatably supported at a proximal end by the bearing 240 and the bearing housing 236. The bearing housing 236 is removably secured in place by the end cap 260. The stator sections 220 are positioned to hold the stator seals 227 in substantially sealing contact with the inner surface 232, the rotor shaft 212, the upper corner seal 286, the lower corner seal 288, and the rotor seal 201.

The pair of fluid ports 270, 272 are in fluidic communication with fluid chambers formed by the housing 230, the rotor 210, the stator seals 227, the upper corner seal 286, the lower corner seal 288, and the rotor seal 201. A collection of axial seals 320 substantially prevent the intrusion of dust, water, and/or other external contaminants into the interior of the example rotary vane actuator with a fluid actuated mechanical lock 100.

The compression plate 284, the spring 282, and the lock piston 280 are assembled about the rotor shaft 212. The spring 282 provides a compliant force separating the compression plate 284 and the lock piston 280. The lock piston 280 is a fluid piston formed to slide axially along the central bore 234 about the rotor shaft 212. When actuated, the lock piston 280 is urged into compressive contact with the spring 282, which in turn compliantly compresses the compression plate and the upper corner seal 286 against the stator seals 227, the rotor seals 210, and the rotor vanes 216. This compression mechanically squeezes the seal-to-seal interfaces tightly to counteract fluid pressure trapped in the actuator 100, thereby locking the fluid within the pressure chambers. Internal leakage across the sealing interfaces is substantially reduced as fluid column pressure is contained.

The example rotary vane actuator with a fluid actuated mechanical lock 100 includes a lock valve assembly 350, shown in additional detail in FIG. 3B.

FIG. 3B is an enlarged partial cross-sectional side view of the lock valve assembly 350 of the example rotary vane actuator with a fluid actuated mechanical lock 100. The assembly 350 includes a fluid duct 352 in fluid communication with a first pair of fluid chambers within the actuator 100. A fluid duct 354 is in fluid communication with a second pair of fluid chambers within the actuator 100. The aforementioned fluid chambers will be discussed in the descriptions of FIGS. 5A-5D.

The lock valve assembly 350 also includes a plunger 360*a* and a plunger 360*b*. A fluid chamber 362 is provided between the plungers 360*a*, 360*b*. The plungers 360*a*, 360*b* are partly biased apart from each other by a bias spring 364 located between the plungers 360*a*, 360*b* within the fluid chamber 362. The plungers 360*a*, 360*b* are also partly biased apart from each other by a pressurized fluid provided to the fluid chamber 364 by a fluid duct 356. The fluid duct 356 is in fluid communication with the fluid port 274 and/or 276, shown in FIG. 2 to receive a supply fluid pressure.

Under normal operating conditions, the plungers 360*a*, 360*b* are biased apart by the bias spring 364 and fluid pressure provided into the fluid chamber 362 by the fluid duct 356. The plungers 360*a* and 360*b* are biased apart with sufficient force to seal the fluid duct 352 and the fluid duct 354 from fluidic communication with a fluid duct 370. In some embodiments, fluid pressure in the pressure chambers and within the fluid ducts 352 and 354 can be substantially maintained by fluidically blocking the fluid ports 270 and 272, e.g., to maintain the rotor 210 in a substantially fixed rotational position. Operations of the example rotary vane actuator with a fluid actuated mechanical lock 100 under "normal" operating conditions is discussed in the descriptions of FIGS. 5A-5D, and use of the fluid duct 370 and operations under "abnormal" (e.g., failure mode) conditions are discussed in the descriptions of FIGS. 6A and 6B.

FIG. 4 is a cross-sectional end view of the example rotary vane actuator with a fluid actuated mechanical lock 100 which includes a one-piece rotor seal 201. The cross-section shown in FIG. 4 is taken along a section generally shown by line AA of FIG. 1. During assembly, the stator sections 220 are inserted into bore 234 of the housing 230 and the fasteners 250 are inserted through the holes 252 and are threaded into the threaded holes 254 to removably secure the stator sections 220 to the housing 230. The stator sections 220 maintain the stator seals 227 in sealing contact with the inner surface 232 and the rotor shaft 212 (not shown in this view). In some embodiments, the stator sections 220 may be fastened to the housing in arrangements other than the one illustrated in the example FIG. 4, which depicts two rows of fasteners arranged axially on each side of the stator seals 227. For example, one or both of the stator sections 220 may be formed with two or more of the stator seal grooves 226, and the fasteners 250, the holes 252, and the threaded holes 254 may be arranged between pairs of the seal grooves 226 formed in a single one of stator sections 220.

FIGS. 5A-5D are cross-sectional end views of the example rotary vane actuator with a fluid actuated mechanical lock 100 in four example rotational configurations 500*a*-500*d*. In some embodiments, the transitions of the configurations shown in FIGS. 5A-5D may be considered as "normal" operations of the actuator 100.

The cross-sectional views of FIGS. 5A-5D show the example rotary vane actuator with a fluid actuated mechanical lock 100 of FIG. 1 with the rotor 210. The rotor 210, the stator sections 220, and the housing 230 form a pair of pressure chambers 510*a*, 510*b* and a pair of pressure chambers 512*a*, 512*b*. The pressure chambers 510*a*, 510*b* are located substantially opposite each other on opposing radial sides of the rotor 210, and are in fluidic communication through a fluid channel 514. A fluid, e.g., hydraulic fluid, air or gas, is applied at the fluid port 270 and flows into the pressure chamber 510*a*, through the fluid channel 514, and into the pressure chamber 510*b*, thereby substantially balancing the pressures in the pressure chambers 510*a* and 510*b*. In reverse flow, the fluid may escape the pressure chamber 510*b* through the fluid channel 514 into the pressure chamber 510*a* and out the fluid port 270. The pressure chambers 512*a*, 512*b* are located substantially opposite each other on opposing radial sides of the rotor 210 opposite the pressure chambers 510*a*, 510*b*, and are in fluidic communication through a fluid channel 516. A fluid, e.g., hydraulic fluid, air, applied at the fluid port 272 can flow into the pressure chamber 512*a*, through the fluid channel 516, and into the pressure chamber 512*b* thereby substantially balancing the pressures in the pressure chambers 512*a* and 512*b*. In reverse flow, the fluid may escape the pressure chamber 512*b* through the fluid channel 516 into the pressure chamber 512*a* and out the fluid port 272.

Figure 5A:
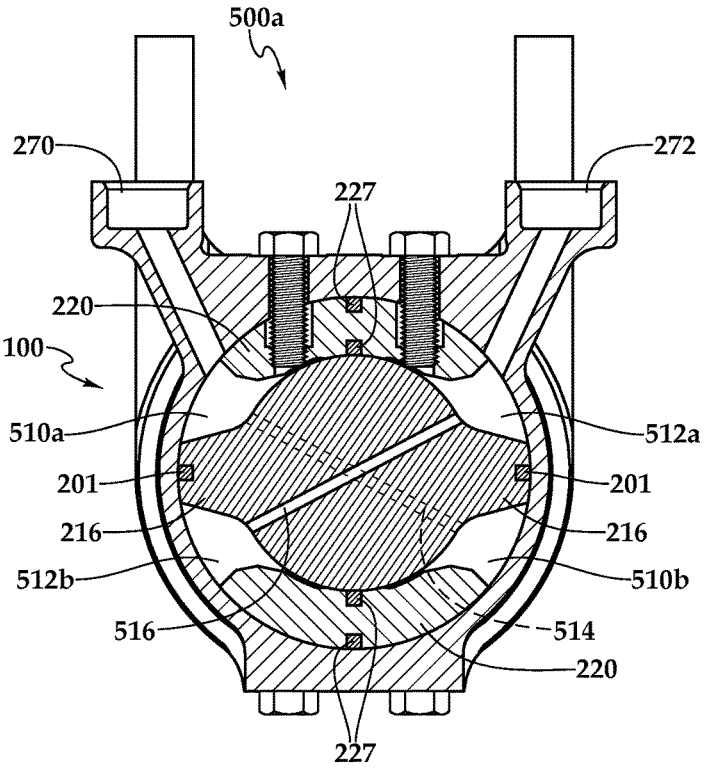
FIGS. 5A-5D are cross-sectional end views of an example rotary vane actuator with a fluid actuated mechanical lock in example rotational configurations.

FIG. 5A depicts the example rotary vane actuator with a fluid actuated mechanical lock 100 of FIG. 1 with the pressure chambers 512*a*, 512*b* pressurized at a mid-stroke rotational configuration of the rotor 210. When fluid is applied to the fluid port 272, the pressure chambers 512*a*, 512*b* become pressurized and urge rotation of the rotor 210 in a clockwise rotational direction. In some implementations, the rotor 210 can be held in a substantially fixed rotational position by holding the pressures of the fluid ports 270 and/or 272 steady, e.g., by fluidically blocking one or both of the fluid ports 270, 272. The configuration of the rotor seals 201 and the stator seals 227 substantially eliminates the use of corner seals used in prior designs and reduces the potential for cross-chamber fluid leakage that occurs across the corner seals of prior designs, and thereby improves the ability of the example rotary vane actuator with a fluid actuated mechanical lock 100 to maintain a rotational position when the fluid ports 270, 272 are held at a steady pressure, e.g., are fluidically blocked.

Figure 5B:
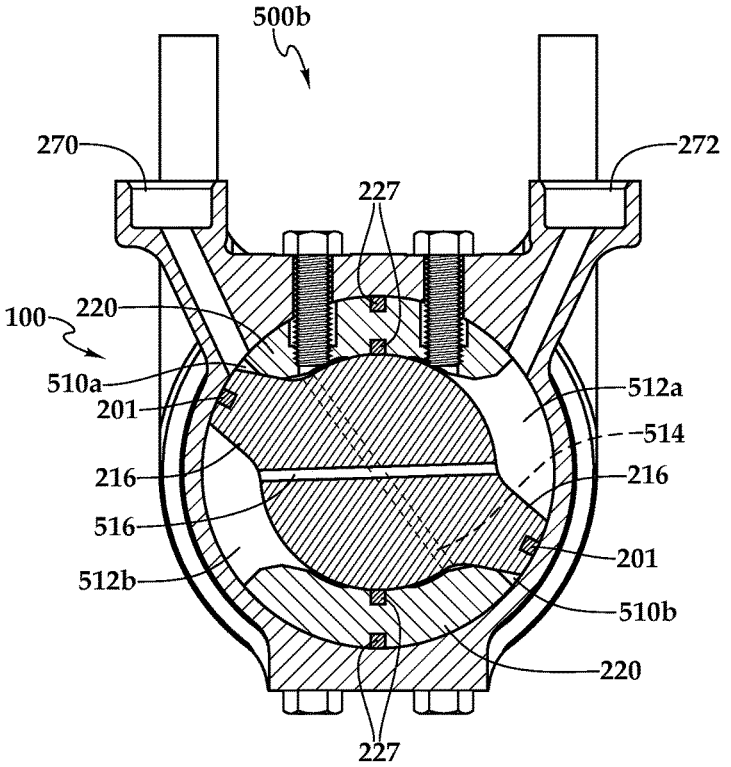

FIG. 5B depicts the example rotary vane actuator with a fluid actuated mechanical lock 100 of FIG. 1 with the pressure chambers 512*a*, 512*b* pressurized at a clockwise hard-stopped rotational configuration of the rotor 210. When fluid is applied to the fluid port 272, the pressure chambers 512*a*, 512*b* become pressurized and urge rotation of the rotor 210 in a clockwise rotational direction. In the illustrated example, the clockwise rotation of the rotor 210 can stop when the clockwise faces of one or both rotor vanes 216 contacts one or both of the counterclockwise end faces of the stator sections 220.

Figure 5C:
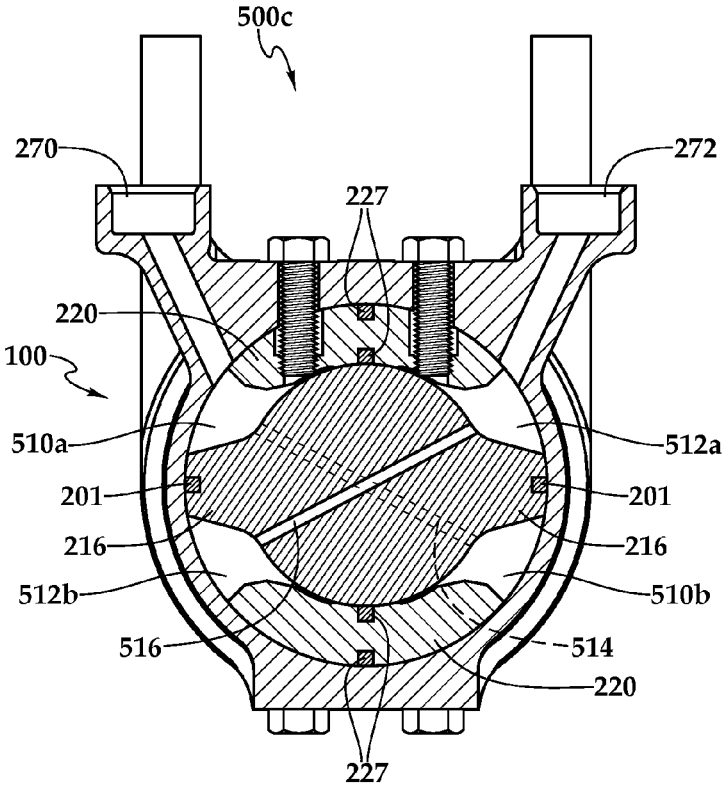

FIG. 5C depicts the example rotary vane actuator with a fluid actuated mechanical lock 100 of FIG. 1 with the pressure chambers 512*a*, 512*b* pressurized at another mid-stroke rotational configuration of the rotor 210. For example, the configuration depicted by FIG. 5C may be achieved when the rotor 210 is rotated away from the rotation configuration shown in FIG. 5B. When fluid is applied to the fluid port 270, the pressure chambers 510*a*, 510*b* become pressurized and urge rotation of the rotor 210 in a counterclockwise rotational direction. In some implementations, the rotor 210 can be held in a substantially fixed rotational position by holding the pressures of the fluid ports 270 and/or 272 steady, e.g., by fluidically blocking one or both of the fluid ports 270, 272.

Figure 5D:
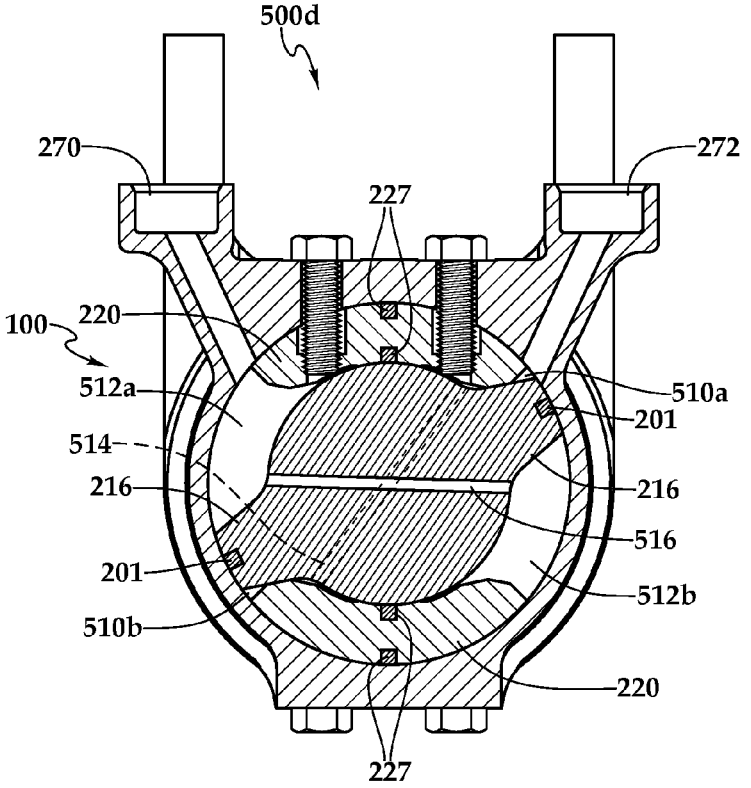

FIG. 5D depicts the example rotary vane actuator with a fluid actuated mechanical lock 100 of FIG. 1 with the pressure chambers 510*a*, 510*b* pressurized at a counterclockwise hard-stopped rotational configuration of the rotor 210. When fluid is applied to the fluid port 270, the pressure chambers 510*a*, 510*b* become pressurized and urge rotation of the rotor 210 in a counterclockwise rotational direction. In the illustrated example, the counterclockwise rotation of the rotor 210 can stop when the counterclockwise faces of one or both rotor vanes 216 contacts one or both of the clockwise end faces of the stator sections 220.

Figure 6A:
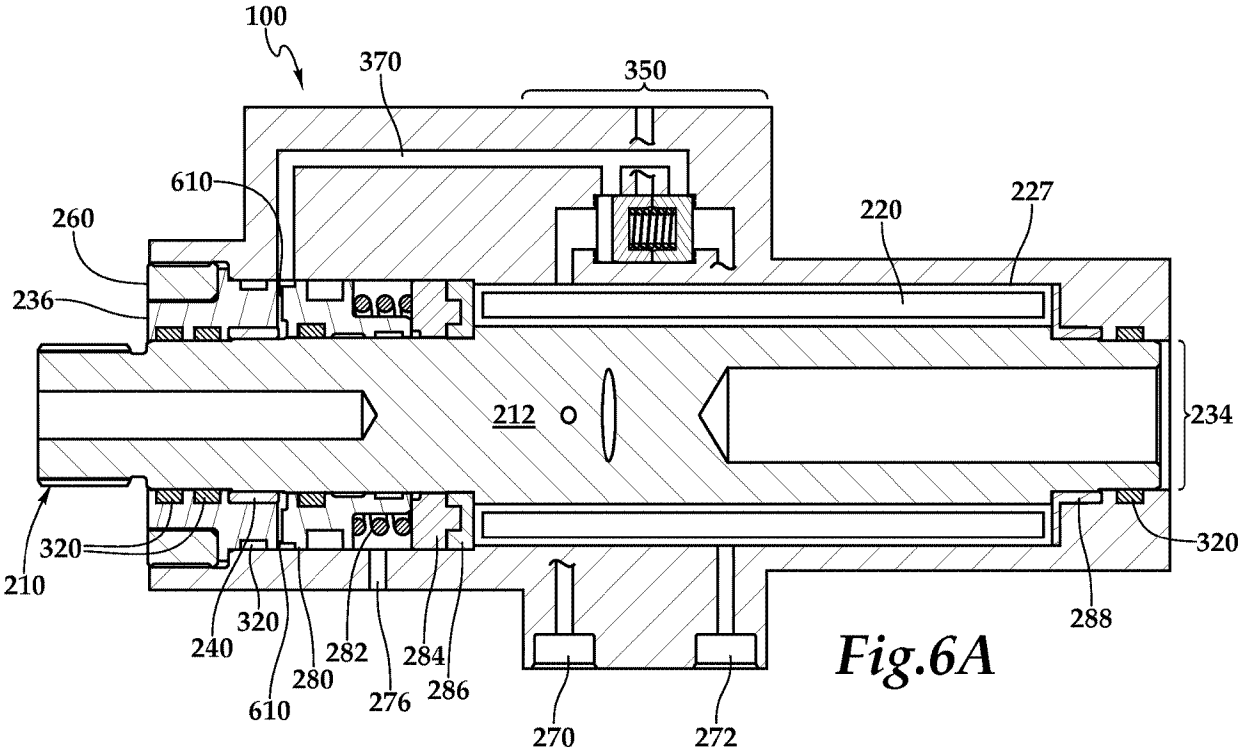
FIGS. 6A and 6B are cross-sectional side views of an example rotary vane actuator with a fluid actuated mechanical lock in a failure mode.
Figure 6B:
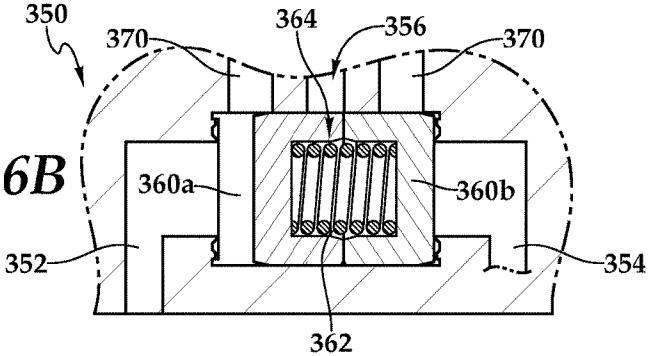

FIGS. 6A and 6B are cross-sectional side views of the example rotary vane actuator with a fluid actuated mechanical lock 100 of FIG. 1 in a failure mode. In some embodiments, the configuration of the actuator 100 as shown in FIGS. 6A and 6B may depict the actuator 100 in an "abnormal" or "failure" operating configuration. Under abnormal operating conditions, such as a fluid supply failure, stator seal 227 failure, or rotor seal 201 failure within the example rotary vane actuator with a fluid actuated mechanical lock 100, the rotor 210 may be urged out of a selected locked position by external forces, e.g., wind resistance or G-forces acting on an aircraft control surface actuated by the rotor 210. The actuator 100 can resist such external action when the pressure in the fluid chamber 364 is lowered. With the pressure in the fluid chamber 364 sufficiently lowered, pressure from the pressure chambers through the fluid ducts 352 and/or 354 can urge one or both of the plungers 360*a*, 360*b* to compress the bias spring 362 and unseal the fluid ducts 352 and/or 354. When one or both of the fluid ducts 352, 354 is unsealed, a fluidic circuit is established between the fluid ducts 352 and/or 354 and a fluid duct 370.

Referring now to FIG. 6B, which is an enlarged partial cross-sectional side view of the lock valve assembly 350 of the example rotary vane actuator with a fluid actuated mechanical lock 100 under "abnormal" operating conditions. As discussed previously, under "normal" operating conditions the plungers 360*a*, 360*b* are biased apart by the bias spring 362 and fluid pressure provided into the fluid chamber 364 by the fluid duct 356. The plungers 360*a* and 360*b* are biased apart with sufficient force to seal the fluid duct 352 and the fluid duct 354 from fluidic communication with a fluid duct 370.

However, during the "abnormal" or "failure" operating mode depicted in FIGS. 6A and 6B, there is insufficient pressure present in the fluid chamber 364 to cause the plungers 360*a*, 360*b* to seal the fluid ducts 352, 354. In some embodiments, pressure in the fluid chamber 364 may drop due to a malfunction, e.g., failure of a fluid pump or a break in a fluid supply line feeding the fluid ports 274 or 276. In some embodiments, pressure in the fluid chamber 364 may be purposely dropped, e.g., as a fluidic control signal to the actuator 100. When pressure builds either of the fluid ducts 352 or 354, the pressure may become sufficient to overcome the bias force of the spring 362 and any remaining fluid pressure in the fluid chamber 364, and urge a corresponding one of the plungers 360*a*, 360*b* to become unsealed and create a fluidic circuit between the corresponding fluid duct 352 or 354 and the fluid duct 370.

In the illustrated example, the plunger 360*a* has been unsealed by pressure from the fluid duct 352, creating a fluidic circuit between the fluid duct 352 and the fluid duct 370. In some implementations, pressure in the fluid ducts 352 and/or 354 can be developed when the rotor 210 is urged to rotate by external forces acting upon a mechanism connected to the rotor 210, e.g., wind resistance or G-forces acting on an aircraft control surface actuated by the actuator 100.

Referring now to FIG. 6A, fluid pressure is provided through the fluid duct 370 of the example rotary vane actuator with a fluid actuated mechanical lock 100 of FIG. 1 to a junction 610 located at the interface of the lock piston 280 and the bearing housing 236. As fluid enters the junction 610, the lock piston 280 is urged toward the spring 282. The spring 282, in turn, is urged into compliant compression against the compression plate 284, which compresses the upper corner seal 286, the rotor 210, and/or the lower corner seal 288. This action creates a tightly compressed sealing interface at the sides of the rotor vanes 216 and the stator sections 220, and the increased seal friction imparted on the rotor 210 by the spring 282 normal force substantially holds position of the rotor shaft 212 and any appropriate actuated load. In some implementations, fluid pressures in the fluid chambers may be increased as the rotor shaft 212 is loaded, and may further energize the upper corner seal 286 and/or the lower corner seal 288, thereby increasing sealing force and/or friction, and substantially lock the rotor 210 from turning.

Although a few implementations have been described in detail above, other modifications are possible. For example, various combinations of single piece rotor seals, multiple piece rotor seals, single piece stator seals, and multiple piece stator seals may be combined to achieve desirable results. In addition, other components may be added to, or removed from, the described actuators. Accordingly, other embodiments are within the scope of the following claims.

What is claimed is:

1. A seal assembly for a rotary vane actuator including:

a compressible seal slidably mounted on a central longitudinal shaft of a rotor assembly, the compressible seal having an outer circumferential surface sized to be received in a bore of a stator housing and configured to be assembled to an end cap, a first lateral surface adapted for contacting a first end surface of a first stator element, a first end surface of a second stator element, a first end surface of a first longitudinal vane, and a first end surface of a second longitudinal vane, and configured to slide axially along the central longitudinal shaft through a central opening sized to receive the central longitudinal shaft, a compression member slidably mounted on the central longitudinal shaft and configured to slide axially along the central longitudinal shaft, wherein the compression member, the end cap, the bore of the stator, the rotor assembly, and the compressible seal define a fluid chamber, a locking piston slidably mounted on the central longitudinal shaft, the locking piston having an end surface adapted to contact the compression member, a circumferential surface sized to be received in the bore of the housing, and a lateral surface axially opposite from the end surface and adapted to receive actuation fluid, the locking piston being configured to slide axially along the central longitudinal shaft through the central opening, a first fluid duct configured to fluidically connect the fluid chamber to the lateral surface, a lock valve assembly comprising a second fluid duct and configured to control fluid flow along the first fluid duct based on a fluid pressure provided at the second fluid duct.

2. The seal assembly of claim 1, wherein:

the first stator element is disposed in the bore of the stator housing, and the first stator element comprises a first stator seal groove disposed in a concave interior surface of the first stator element adapted to contact a cylindrical surface on the central longitudinal shaft, disposed in a convex outer surface of the first stator element adapted to be secured to the bore of the stator housing, disposed in a first stator end surface of the first stator element disposed perpendicular to the central axis, and disposed in a second stator end surface of the first stator element disposed perpendicular to the central axis, and a first stator seal disposed in said first stator seal groove, and the second stator element disposed in the bore of the stator housing, and the second stator element comprises a second stator seal groove disposed in a concave interior surface of the second stator element adapted to contact a cylindrical surface on the central longitudinal shaft, disposed in a convex outer surface of the second stator element adapted to be secured to the bore of the stator housing, disposed in a first stator end surface of the second stator element disposed perpendicular to the central axis, and disposed in a second stator end surface of the second stator element disposed perpendicular to the central axis, and a second stator seal disposed in said second stator seal groove.

3. A sealing mechanism for a rotary vane actuator comprising:

a stator housing having a bore disposed axially therethrough;

an end cap configured to be assembled to the stator housing;

a rotor assembly including:

a central longitudinal shaft having a central axis, and at least a first longitudinal vane disposed radially on the central longitudinal shaft, and a second longitudinal vane disposed radially on the central longitudinal shaft, a stator assembly including:

a first stator element disposed in the bore of the stator housing, and a second stator element disposed in the bore of the stator housing, wherein the first longitudinal vane and the first stator element define a first pressure chamber inside the bore of the stator housing, the second longitudinal vane and the first stator element define a second pressure chamber inside the bore of the stator housing, the second longitudinal vane and the second stator element define a third pressure chamber inside the bore of the stator housing, and the second longitudinal vane and the first stator element define a fourth pressure chamber inside the bore of the stator housing, a seal assembly including:

a compressible seal slidably mounted on the central longitudinal shaft of the rotor assembly, the compressible seal having an outer circumferential surface received in the bore of the stator housing, the compressible seal being configured to slide axially along the central longitudinal shaft through a central opening sized to receive the central longitudinal shaft, a compression member slidably mounted on the central longitudinal shaft and configured to slide axially along the central longitudinal shaft, a locking piston slidably mounted on the central longitudinal shaft, the locking piston having an end surface adapted to contact the compression member, a circumferential surface sized to be received in the bore of the housing, and a lateral surface axially opposite from the end surface and adapted to receive actuation fluid, the locking piston being configured to slide axially along the central longitudinal shaft through the central opening, a first fluid duct configured to fluidically connect the first pressure chamber and the third pressure chamber to the lateral surface, a second fluid duct configured to fluidically connect the second pressure chamber and the fourth pressure chamber to the lateral surface, a lock valve assembly comprising a third fluid duct and configured to control fluid flow along the first fluid duct and the second fluid duct based on a fluid pressure provided at the third fluid duct.

4. The sealing mechanism of claim 3 further including a port and passageways in the housing adapted to provide actuation fluid to the lateral surface of the locking piston.

5. The sealing mechanism of claim 3 further having a biasing member disposed around the central longitudinal shaft in the central bore of the housing having a first end contacting the compression member and a second end adapted to contact the locking piston.

6. The sealing mechanism of claim 3 further comprising:

a first seal groove disposed in a first end surface of the first longitudinal vane and a first seal disposed in said first seal groove;

a second seal groove disposed in a first end surface of the second longitudinal vane and a second seal disposed in said second seal groove;

a third seal groove disposed in a first end surface of the first stator element and a third seal disposed in said third groove; and a fourth seal groove disposed in a first end surface of the second stator element and a fourth seal disposed in said fourth seal groove;

wherein a portion of a lateral surface of the compressible seal of the seal assembly contacts the first seal disposed in the first seal groove, contacts the second seal disposed in the second seal groove, contacts the third seal disposed in the third seal groove, and contacts the fourth seal disposed in the fourth seal groove.

7. The sealing mechanism of claim 3, wherein:

the first stator element comprises a first stator seal groove disposed in a concave interior surface of the first stator element adapted to contact a cylindrical surface on the central longitudinal shaft, disposed in a convex outer surface of the first stator element adapted to be secured to the bore of the stator housing, disposed in a first stator end surface of the first stator element disposed perpendicular to the central axis, and disposed in a second stator end surface of the first stator element disposed perpendicular to the central axis, and a first stator seal disposed in said first stator seal groove; and the second stator element comprises a second stator seal groove disposed in a concave interior surface of the second stator element adapted to contact a cylindrical surface on the central longitudinal shaft, disposed in a convex outer surface of the second stator element adapted to be secured to the bore of the stator housing, disposed in a first stator end surface of the second stator element disposed perpendicular to the central axis, and disposed in a second stator end surface of the second stator element disposed perpendicular to the central axis, and a second stator seal disposed in said second stator seal groove.

8. A sealing mechanism for a rotary vane actuator comprising:

a stator housing having a bore disposed axially therethrough;

an end cap configured to be assembled to the stator housing;

a rotor assembly including:

a central longitudinal shaft having a central axis, and at least a first longitudinal vane disposed radially on and rigidly connected to the central longitudinal shaft, said first longitudinal vane having a first end surface disposed perpendicular to the central axis and a second end surface disposed perpendicular to the central axis, and a second longitudinal vane disposed radially on and rigidly connected to the central longitudinal shaft, said second longitudinal vane having a first end surface disposed perpendicular to the central axis, and a second end surface disposed perpendicular to the central axis, said second vane disposed substantially opposite from the first vane, a stator assembly including:

a first stator element disposed in the bore of the stator housing, and having a first end surface disposed perpendicular to the central axis, and a second end surface disposed perpendicular to the central axis, and a second stator element disposed in the bore of the stator housing, and having a first end surface disposed perpendicular to the central axis, and a second end surface disposed perpendicular to the central axis; and a seal assembly including:

a compressible seal slidably mounted on the central longitudinal shaft of the rotor assembly, the seal having an outer circumferential surface sized to be received in the bore of the stator housing a first lateral surface adapted for contacting the first end surface of the first stator element, the first end surface of the second stator element, the first end surface of the first longitudinal vane, and the first end surface of the second longitudinal vane, and configured to slide axially along the central longitudinal shaft through a central opening sized to receive the central longitudinal shaft, a compression member slidably mounted on the central longitudinal shaft and configured to slide axially along the central longitudinal shaft, the compression member having a first surface adapted to contact a second lateral surface of the compressible seal, wherein the compression member, the end cap, the bore of the stator, the rotor assembly, and the compressible seal define a fluid chamber, a locking piston slidably mounted on the central longitudinal shaft, the locking piston having an end surface adapted to contact the compression member, a circumferential surface sized to be received in the bore of the stator housing, and a lateral surface axially opposite from the end surface and adapted to receive actuation fluid, the locking piston being configured to slide axially along the central longitudinal shaft through the central opening, a first fluid duct configured to fluidically connect the fluid chamber to the lateral surface, a lock valve assembly comprising a second fluid duct and configured to control fluid flow along the first fluid duct based on a fluid pressure provided at the second fluid duct.

9. The sealing mechanism of claim 8 further including a port and passageways in the stator housing adapted to provide actuation fluid to the second lateral surface of the locking piston.

10. The sealing mechanism of claim 8 further having a biasing member disposed around the central longitudinal shaft in the central bore of the stator housing having a first end contacting the compression member and a second end adapted to contact the locking piston.

11. The sealing mechanism of claim 8 further comprising:

a first seal groove disposed in a first end surface of the first longitudinal vane and a first seal disposed in said first seal groove;

a second seal groove disposed in a first end surface of the second longitudinal vane and a second seal disposed in said second seal groove;

a third seal groove disposed in a first end surface of the first stator element and a third seal disposed in said third groove; and a fourth seal groove disposed in a first end surface of the first stator element and the first end surface of the second stator element and a fourth seal disposed in said fourth seal groove;

wherein a portion of the first lateral surface of the compressible seal of the seal assembly contacts the first seal disposed in the first seal groove, contacts the second seal disposed in the second seal groove, contacts the third seal disposed in the third seal groove, and contacts the fourth seal disposed in the fourth seal groove.

12. The sealing mechanism of claim 8 wherein the first longitudinal vane and the first stator define a first pressure chamber inside the bore of the stator housing;

the second longitudinal vane and the first stator element define a second pressure chamber inside the bore of the stator housing;

the second longitudinal vane and the second stator element define a third pressure chamber inside the bore of the stator housing; and the second longitudinal vane and the first stator element define a fourth pressure chamber inside the bore of the stator housing.

13. The sealing mechanism of claim 8 wherein:

the first stator element comprises a first stator seal groove disposed in the concave interior surface of the first stator element, disposed in the convex outer surface of the first stator element, disposed in the first stator end surface of the first stator element perpendicular to the central axis, and disposed in the second stator end surface of the first stator element perpendicular to the central axis, and a first stator seal disposed in said first stator seal groove; and the second stator element comprises a second stator seal groove disposed in the concave interior surface of the second stator element, disposed in the convex outer surface of the second stator element, disposed in the first stator end surface of the second stator element perpendicular to the central axis, and disposed in the second stator end surface of the second stator element perpendicular to the central axis, and a second stator seal disposed in said second stator seal groove.

14. A method of actuation of a seal assembly comprising:

providing a rotary vane actuator including:

a stator housing having a bore disposed axially therethrough and a collection of holes formed therethrough;

an end cap configured to be assembled to the stator housing;

a rotor assembly including:

a central longitudinal shaft having a central axis, and at least a first longitudinal vane disposed radially on the central longitudinal shaft, and at least a second longitudinal vane disposed radially on the central longitudinal shaft, a stator assembly including:

a first stator element disposed in the bore of the stator housing, and a second stator element disposed in the bore of the stator housing, wherein the first longitudinal vane and the first stator element define a first pressure chamber inside the bore of the stator housing, the second longitudinal vane and the first stator element define a second pressure chamber inside the bore of the stator housing, the second longitudinal vane and the second stator element define a third pressure chamber inside the bore of the stator housing, and the second longitudinal vane and the first stator element define a fourth pressure chamber inside the bore of the stator housing, a seal assembly including:

a compressible seal slidably mounted on the central longitudinal shaft of the rotor assembly, the seal having an outer circumferential surface received in the bore of the stator housing, a first lateral sealing surface and a second lateral sealing surface axially opposite from the first lateral sealing surface, the compressible seal being configured to slide axially along the central longitudinal shaft through a central opening sized to receive the central longitudinal shaft, a compression member slidably mounted on the central longitudinal shaft and configured to slide axially along the central longitudinal shaft, the compression member having a first surface and second surface axially opposite from the first surface, a locking piston slidably mounted on the central longitudinal shaft, the locking piston including an end surface, a circumferential surface received in the bore of the housing, a lateral surface axially opposite from the first surface, and a biasing member disposed between the compression member and the lateral surface;

a first fluid duct configured to fluidically connect the first pressure chamber and the third pressure chamber to the end surface of the lock piston;

a second fluid duct configured to fluidically connect the second pressure chamber and the fourth pressure chamber to the end surface of the lock piston;

a lock valve assembly comprising a third fluid duct and configured to control fluid flow along the first fluid duct and the second fluid duct based on second fluid pressure provided at the third fluid duct;

providing first pressurized fluid to one or more of the first pressure chamber, the second pressure chamber, the third pressure chamber, or the fourth pressure chamber;

providing the first pressurized fluid to the lock valve assembly through one or both of the first fluid duct and the second fluid duct;

providing the second fluid pressure at the third fluid duct;

blocking, by the lock valve assembly and based on the second fluid pressure, fluid flow from one or both of the first fluid duct and the second fluid duct to the end surface of the locking piston;

relieving the second fluid pressure at the third fluid duct;

providing, through the lock valve assembly and based on the relieved second fluid pressure, the first pressurized fluid to the end surface of the locking piston;

slidably displacing the locking piston axially along the central longitudinal shaft and contacting the biasing member;

slidably displacing the biasing member axially along the central longitudinal shaft into contact with the compression member and thereby partially compressing the biasing member; and contacting the first lateral sealing surface of the compressible seal with the compression member and slidably displacing the compressible seal axially along the central longitudinal shaft into sealing contact with a first end surface of the first longitudinal vane, a first end surface of the second longitudinal vane, a first end surface of the first stator element, and a first end surface of the second stator element.

15. The method of actuation of claim 14 wherein the rotary actuator further includes:

a first seal groove disposed in a first end surface of the first longitudinal vane and a first seal disposed in said first seal groove;

a second seal groove disposed in a first end surface of the second longitudinal vane and a second seal disposed in said second seal groove;

a third seal groove disposed in a first end surface of the first stator element and a third seal disposed in said third groove; and a fourth seal groove disposed in a first end surface of the second stator element and a fourth seal disposed in said fourth seal groove; and the method further includes contacting with a portion of the first lateral sealing surface of the compressible seal of the seal assembly with the first seal disposed in the first seal groove, the second seal disposed in the second seal groove, the third seal disposed in the third seal groove, and the fourth seal disposed in the fourth seal groove.

16. The method of actuation of claim 14 wherein, wherein:

the first stator element comprises a first stator seal groove disposed in a concave interior surface adapted to contact a cylindrical surface on the central longitudinal shaft, disposed in a convex outer surface adapted to be secured to the bore of the stator housing, disposed in a first stator end surface of the first stator element disposed perpendicular to the central axis, and disposed in a second stator end surface of the first stator element disposed perpendicular to the central axis, and a first stator seal disposed in said first stator seal groove; and the second stator element comprises a second stator seal groove disposed in a concave interior surface adapted to contact a cylindrical surface on the central longitudinal shaft, disposed in a convex outer surface adapted to be secured to the bore of the stator housing, disposed in a first stator end surface of the second stator element disposed perpendicular to the central axis, and disposed in a second stator end surface of the second stator element disposed perpendicular to the central axis, and a second stator seal disposed in said second stator seal groove.

* * * * *